US007919957B2

(12) United States Patent
Verma et al.

(10) Patent No.: US 7,919,957 B2
(45) **Date of Patent: *Apr. 5, 2011**

(54) DIGITAL LINEAR VOLTAGE REGULATOR

(75) Inventors: Shwetabh Verma, Sunnyvale, CA (US); Marc Loinaz, Palo Alto, CA (US)

(73) Assignee: NetLogic Microsystems, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/723,538

(22) Filed: Mar. 12, 2010

(65) Prior Publication Data

US 2010/0164445 A1 Jul. 1, 2010

Related U.S. Application Data

(63) Continuation of application No. 11/869,595, filed on Oct. 9, 2007, now Pat. No. 7,679,345.

(51) Int. Cl.
*G05F 1/40* (2006.01)

(52) U.S. Cl. ..... 323/273

(58) Field of Classification Search ..... 323/268, 323/270, 273, 275, 276, 279, 281
See application file for complete search history.

(56) References Cited

U.S. PATENT DOCUMENTS 6,031,362 A * 2/2000 Bradley ..... 323/269
6,198,275 B1 * 3/2001 Wolf et al. ..... 324/207.12
7,283,784 B2 * 10/2007 Smith et al. ..... 455/3.02
2007/0290894 A1 * 12/2007 Ng et al. ..... 341/50

OTHER PUBLICATIONS

Gabriel, Active Capacitor Multiplier in Miller-Compensated Circuits, IEEE Transactions on Solid-State Circuits, vol. 35, No. !, Jan. 2000.

Hazucha et al., Area-Efficient Linear Regulator, With Ultra-Fast Load Regulation. IEEE Journal of Solid-State Circuits, vol. 40, No. 4, Apr. 2005.

* cited by examiner

*Primary Examiner* — Matthew V Nguyen
(74) *Attorney, Agent, or Firm* — Stattler-Suh PC

(57) ABSTRACT

A digital linear voltage regulator includes a comparator, a finite state machine, and a current digital-to-analog converter (DAC). The comparator is preferably coupled to receive a reference voltage and an operating voltage supplied to a dynamic load. The comparator generates, during a clock cycle, a binary output based on a comparison between reference and operating voltages. The finite state machine (FSM) is coupled to receive at least one control signal that indicates a target operating state for the digital linear voltage regulator. The FSM receives the binary output from the comparator and generates a digital word, during a clock cycle, based on the target operating state of the digital linear voltage regulator and on the binary output. The current DAC is coupled to the FSM, receives the digital word and delivers current at the desired voltage to the dynamic load.

19 Claims, 3 Drawing Sheets

DIGITAL LINEAR VOLTAGE REGULATOR

RELATED APPLICATIONS

This patent application claims benefit and priority to, under 35 U.S.C. §120, and is a continuation of the U.S. patent application entitled "A Digital Linear Voltage Regulator," having Ser. No. 11/869,595 filed on Oct. 9, 2007, now U.S. Pat. No. 7,679,345 which is expressly incorporated herein by reference.

BACKGROUND OF THE INVENTION

1. Field of the Invention

The present invention is directed toward the field of power regulation, specifically integrated linear voltage regulators.

2. Art Background

Modern VLSI systems tend toward low cost-of-manufacture designs with low power consumption. Complementary metal-oxide semiconductor (CMOS) fabrication technology is particularly attractive: it is relatively low-cost, has high-performance, and permits the integration of many device functionalities on a single chip.

Many CMOS applications would benefit from on-chip linear voltage regulation to convert relatively higher supply voltage to a lower operating voltage, e.g. 1.5 V supply to 1 V operating. This would allow the use of newer CMOS technologies, resulting in lower power consumption. For example, a fully buffered dual in-line memory module (FB-DIMM) supplements dynamic random access memory (DRAM) capacity of a computer system. The Joint Electron Device Engineering Council (JEDEC) FBDIMM specification, JESD 82-20, "FBDIMM: Advance Memory Buffer (AMB)," calls for an on-board supply voltage of 1.5 V for the Advanced Memory Buffer (AMB) with high-speed serial links between the Host and the AMB may operate at 3.2/4.0/4.8 Gigabits per second. A 1.5 V design, i.e. without regulating the supply voltage down, would require at least 0.13 μm CMOS technology.

However, integration of traditional linear voltage regulator designs would pose several challenges. First, feedback control loops must be stabilized over a wide range of load current conditions without compromising bandwidth. Second, because low power design schemes often operate power-hungry blocks with lower duty cycles, requiring fast turn-on/off transients, regulator designs must be extremely agile and tolerant of dramatic changes in load current. In the FBDIMM spec, for example, the AMB device may have only 100 nanoseconds to transition into, and out of, a low-power 'L0s' state. In essence, low power operating schemes tend to exacerbate an already challenging design problem, rendering traditional linear voltage regulator designs unsuitable for CMOS integration.

Specifically, FIG. 1 shows a conventional linear voltage regulator design. The current source 100 supplies the dynamic load 110. An analog error amplifier 130 senses the residual difference between the power supply voltage of the current source 100, which is the voltage being regulated, and an ideal reference voltage produced by the source 120. Based on this residual, the amplifier 130 produces an analog control voltage that is supplied to the current source 100. The current source 100 adjusts its strength based on the control voltage to drive the residual error to zero.

There are at least two major requirements for most linear voltage regulators: first, the regulator feedback loop, here the path between the current source 100 and the error amplifier 130, must be stable over various load conditions; second, the regulator feedback loop may need to be agile to adapt to a rapidly changing current load.

Often, these are conflicting requirements. There are usually at least two major poles in this feedback system—at the input and the output of the analog amplifier. First, there is usually a large fixed-bypass capacitor that sits on the power supply node for high-frequency power supply noise rejection. The large capacitor (150 in FIG. 1), together with the variable resistance of a dynamic load, results in a major pole in the feedback system. Additionally, the output of the analog amplifier usually has large output resistance to ensure that the loop gain is sufficiently large for small residual error. This output node also has some parasitic capacitance (140 in FIG. 1), resulting in yet another major pole in the system. The variability of the dynamic load may cause the position of first major pole to vary significantly. To make the stability of the feedback system robust to such variation, designers may choose to make the second pole the 'dominant' one by making capacitor 140 larger. This results in lower bandwidth and slower response times for the linear voltage regulator. As a result, stabilizing this system over a wide variety of loading conditions, without compromising bandwidth, is a difficult task.

To make things worse, in aggressive power conservation schemes in modern low-power VLSI systems, the current load may change from a ratio of 3:1 or more, over an extremely short time interval. Under such conditions, satisfying both these requirements may prove to be a daunting task.

SUMMARY OF THE INVENTION

Some embodiments relate to digital linear voltage regulators. For example, a digital regulator comprises a comparator, a finite state machine, and a current digital-analog converter (DAC). The comparator is preferably coupled to receive a reference voltage and an operating voltage obtained by supplying current to a dynamic load. The comparator generates, during a clock cycle, a binary output based on a comparison between the reference voltage and the operating voltage. The finite state machine (FSM) is coupled to receive at least one control signal that indicates a target operating state for the digital linear voltage regulator. The FSM receives the binary output from the comparator and generates a digital word, during a clock cycle, based on the target operating state of the digital linear voltage regulator and on the binary output. The current DAC is coupled to the FSM, receives the digital word and delivers current at the operating voltage to the dynamic load.

Some embodiments relate to methods of regulating voltage in a circuit. For example, a method comprises steps of: generating, during a clock cycle, a binary output based on a comparison between a reference voltage and an operating voltage supplied to a dynamic load; receiving at least one control signal that indicates a target operating state for voltage regulation; generating a digital word based on said target operating state and the binary output; and delivering current at the operating voltage to the dynamic load based on the digital word.

DETAILED DESCRIPTION

This disclosure sets forth architecture for digital linear voltage regulators that overcome limitations of conventional voltage regulators surrounding integration with VLSI systems by employing digital control.

Structure

Figure 1:
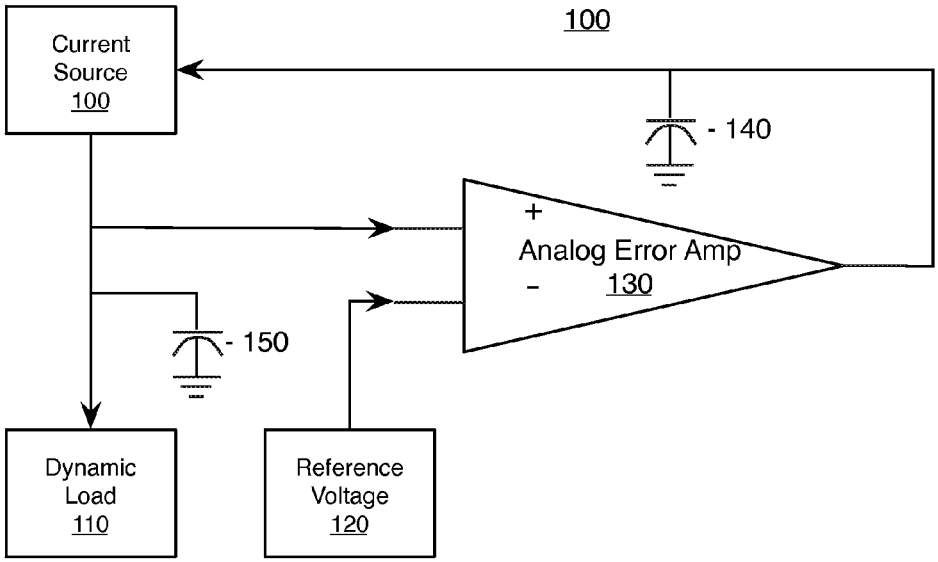
FIG. 1 is a block diagram of an analog linear voltage regulator.
Figure 2:
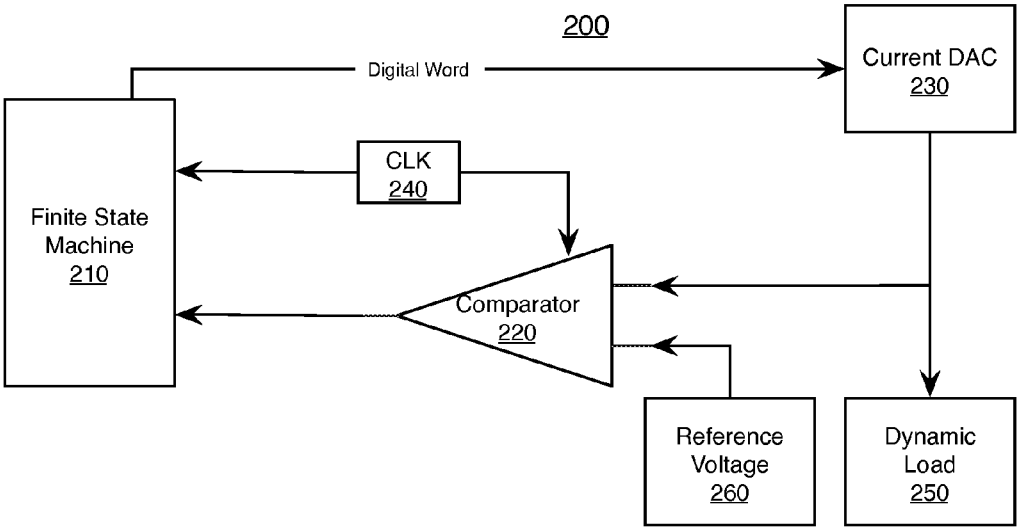
FIG. 2 is a block diagram of a digital linear voltage regulator consistent with some embodiments of the present invention.

FIG. 2 illustrates a digital linear voltage regulator consistent with some embodiments. The regulator 200 includes a current digital-to-analog converter (DAC) 230 that supplies a dynamic load 250 under control of a feedback loop that includes a finite state machine (FSM) 210. An input of the current DAC 230 is coupled to the FSM 210 and an output of the current DAC 230 is coupled both the dynamic load 250 and to an input of a comparator 220. Another input of the comparator 220 is coupled to a reference voltage 260. An output of the comparator 220 is coupled to an input of the FSM 210. The comparator 220 is clocked, as is the FSM 210; the clock 240 supplies both with a signal.

Comparator 220 is preferably a clocked comparator with a programmable dead-band region. The comparator 220 compares the supply voltage from the current DAC 230 with a reference voltage 260, producing a binary output.

Current DAC 230 is preferably a digital-to-analog converter controllable through a digital interface. Preferably the current DAC 230 is implemented for control via the supply of a digital word from the FSM 210. The DAC 230 supplies current with parameters determined by the digital word currently supplied by FSM 210. Alternatively, the DAC 230 supplies current with parameters determined by an operating digital word stored therein. Preferably, in this case, the operating digital word is updated based on digital word supplied by FSM 210.

Reference voltage 260 supplies a voltage at a reference appropriate to the implementation specifics of regulator 200. Preferably the reference voltage 260 is substantially close to a desired supply voltage for the dynamic load. Reference voltage 260 preferably operates at a level substantially unaffected by noise.

The FSM 210 is clocked and operates to output digital words based on input from the comparator 220. Preferably, FSM 210 samples the comparator 220 output at discrete times according to the clock signal supplied by clock 240. Further, FSM 210 preferably includes capability to base portions of the output digital word on predetermined values. Preferably predetermined portions of the digital word are based on target operating state values stored within the FSM 210. For example, target operating state values stored via a look-up table or some other form of stored memory.

Dynamic load 250 preferably represents a current load that requires a wide range of potential load current conditions. Preferably the load 250 presents dramatic changes in load current during operation. Further the load 250 preferably represents a current load consistent with aggressive power conservation schemes, (e.g. as found in modern low-power VLSI systems). For example, in some embodiments the dynamic load 250 changes by a ratio of 3:1 or more, over an extremely short time interval, (e.g. only 100 nanoseconds to transition into, and out of, the low-power state).

Operation

In operation, the current DAC 230 draws power from a supply voltage from some external source, and produces a current output consistent with parameters determined by its operating digital word (stored therein and/or supplied by the FSM 210). The current output is supplied to both the dynamic load 250 and to the comparator 220. This current output, delivered to the dynamic load, generates an output voltage. Meanwhile, a reference voltage 260 supplies the comparator 220, which compares this generated voltage to the reference voltage and supplies a signal indicative of the difference between the reference voltage and the operating voltage to the FSM 210. At discrete times determined based a signal from clock 240, the FSM 210 samples the comparator 220 signal, and based on the value of the signal produces a digital word stored to the current DAC 230. Then, the DAC produces current based on the new stored digital word, and the feedback continues as before.

Most preferably the digital word produced by the FSM 210 is based both on the signal from the comparator 220 and on stored values. In this manner, target operating state values specific to the implementation permit rapid adjustment of the digital word value to the general neighborhood required by a known operational mode.

Preferably the specific target operating state values used to generate the code word are determined in part based on control signals supplied to the FSM 210 from outside the regulator 200, or from the dynamic load 250. Preferably the target operating state values are appropriate to the dynamic load 250 and are determined by calibration or estimation, though other means for determining target operating state values are considered. By using target operating state values to produce the digital word supplied to the current DAC 230, and by selecting the specific target operating state value to use based on input from the dynamic load 250 or some external control logic, the digital word supplied to the current DAC 230 on initiation of a given operational mode corresponds to an operating voltage relatively close to the eventual voltage on which the feedback loop settles. This reduces the settling time of the regulator.

In addition, the resolution of the digital word by which the FSM 210 adjusts the operating voltage during a feedback step is dynamically adjusted in some embodiments. Preferably this adjustment is based on control signals supplied to the FSM 210. For example, following a transition to a different target operating state, the resolution of adjustment is preferably relatively low. Then, following detection of convergence or after a pre-determined time period, the resolution is set to a relatively higher resolution for tighter control over the operating voltage. In some embodiments, the resolution is scaled discretely from a relatively low setting to a relatively high setting over a period of time. Preferably the resolution corresponds to the minimum step by which voltage changes in this way: lower resolution corresponds to larger minimum step size, while higher resolution corresponds to smaller minimum step size. Preferably the resolution is implemented by setting the step size according to the value of the least significant bit (LSB) of the digital word.

Preferably in some embodiments the current DAC 230 is driven open loop when the FSM 210 is not setting the digital word. For example, if the digital word is set on the edges of the clock period, the DAC 230 is driven open loop between the transitions occurring at those edges. Though the stability issues of such embodiments are preferably more relaxed, the voltage across the load 250 will wander or 'dither' about the desired mean value at every clock transition, due to the bistable nature of the comparator 220. To counter this dithering effect, the FSM 210 preferably employs adjustable hysteresis effects in the comparator 220. This prevents the comparator 220 from continuously toggling between its high and low states when the voltage across the dynamic load 250 and the reference voltage 260, are very close to each other. Also, a minimum LSB step size may be used in the current DAC 230 to reduce the dither.

The flexibility allowed by digital design permits the feedback loop in regulator 200 to remain stable over various load conditions while adapting to a rapidly changing current load.

Implementations

Figure 3A:
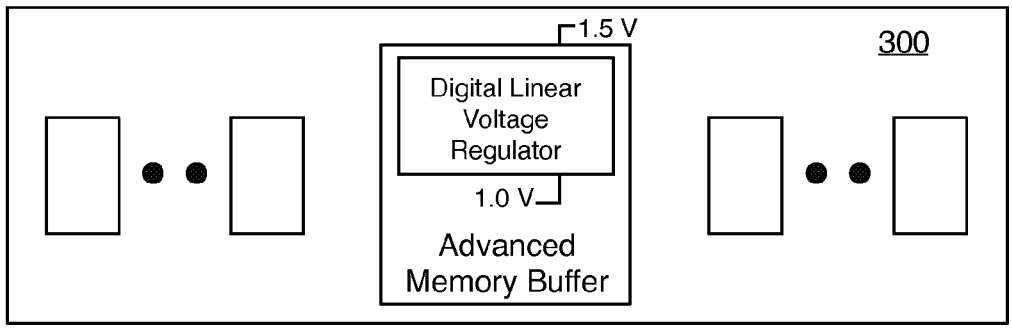
FIG. 3A is a block diagram of a fully buffered dual in-line memory module (FBDIMM) incorporating an integrated digital linear voltage regulator consistent with some embodiments of the present invention.

FIG. 3A illustrates a potential implementation of a digital linear voltage regulator consistent with some embodiments, including the preferred embodiment. In FIG. 3A, an FBDIMM 300 includes a plurality of memory elements supplied with power through an advanced memory buffer (AMB). The AMB includes a regulator consistent with some embodiments that regulates input voltage of 1.5 V down to 1.0 V. Preferably the device 300 is consistent with a JEDEC FB-DIMM standard, e.g. JESD 82-20.

Figure 3B:
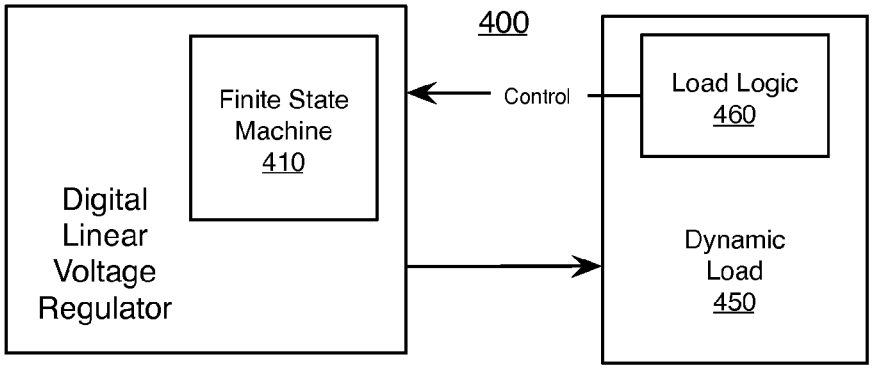
FIG. 3B is a block diagram of a digital linear voltage regulator supplying a dynamic load, consistent with some embodiments of the present invention.

FIG. 3B illustrates a potential implementation of a digital linear voltage regulator consistent with some embodiments. The regulator is implemented as part of a system 400 to supply a dynamic load 450 (e.g. integrated circuits which draw variable power based on operating conditions) that includes a load logic element 460 (control/observation logic that is constantly aware of the power usage requirements for various applications). The load logic element supplies signals indicative of transitions in load current requirements, (e.g. operating mode changes) to a finite state machine (FSM) 410 of the regulator. For example, the load logic 460 supplies a sleep mode signal to the FSM 410 during operation as the load 450 enters a sleep mode. Exemplary implementations consistent with the system 400 include are observation/control logic within modern microprocessors which throttle power for high-power, high-speed circuits, based on application requirements.

Finite State Machine

Figure 4:
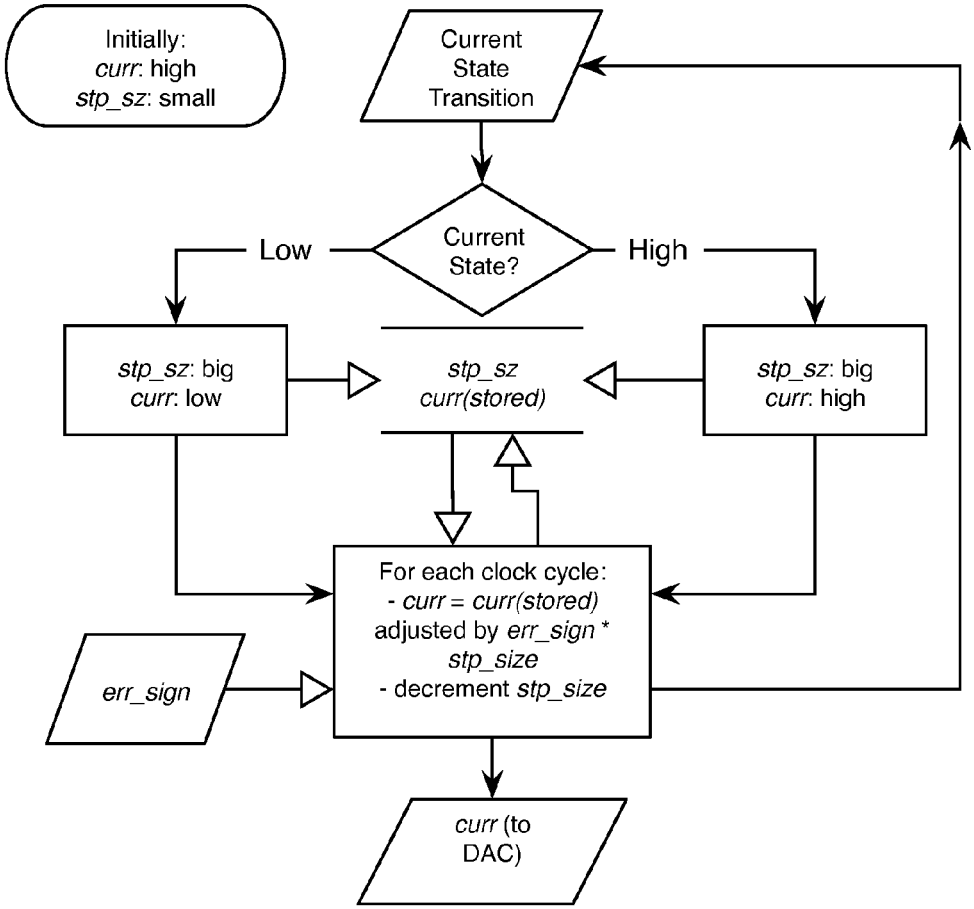
FIG. 4 is a flow chart illustrating a finite state machine for a digital linear voltage regulator consistent with some embodiments of the present invention

FIG. 4 is a flow chart illustrating an implementation of a finite state machine (FSM) for use in a digital linear voltage regulator consistent with some embodiments. The dynamic load in this embodiment can have two operating conditions: a 'high' current state, and 'low' current state. The FSM illustrated operates to form digital words for control of the current DAC. The inputs to the FSM are current state transitions, preferably signals indicating power state changes in the dynamic load, and a variable err_sign that indicates the direction to converge, preferably a signal from the comparator. Based on these the FSM maintains variables curr, corresponding to the output state and stp_sz, corresponding to the adjustment resolution. In this model FSM, the variable curr is reset to 'high' and 'low,' for high and low current operating conditions of the dynamic load. These values are estimates of the final converged values for curr for the two operating conditions, discovered by some means (e.g. calibration, or retention). The variable stp_sz assumes values ranging from 'big' to 'small'. Initially curr is 'high' and stp_sz is 'small'.

At a current state transition (e.g. from a high-current state to a low-current one), the FSM determines the value of the current state and resets curr appropriately (e.g. 'low'). The FSM also sets stp_sz to 'big'. Then, for each clock cycle, the FSM determines err_sign from the comparator. Then the FSM calculates the next value for curr as equal to the previous stored value of curr adjusted by stp_sz with sign err_sign. For example curr=curr(stored)−stp_sz*err_sign. is one possible adjustment. The curr variable is written as a digital control word output to the DAC. Then, stp_sz is decremented in a predetermined monotonic fashion.

Thus, at each clock cycle where no state change occurs, the resolution increases and the digital word is adjusted based on the comparator signal to move towards convergence. State transitions reset the resolution to achieve rapid initial convergence at low resolution and reset the initial digital word according to the new operating condition.

Advantages

Digital control permits high frequency operation and stability across a wide range of current conditions. Preset target operational modes and programming of in-chip operational requirements into the design, together with dynamic adjustment of stepping resolution, permit very rapid initial convergence. This combination permits integration with VLSI systems using more advanced fabrication technology. In addition, digital control permits programming to account for hysteresis effects and maintain tighter control over voltage dither during maintained periods at converged operating voltage.

A fully integrated linear voltage regulator generates relatively lower operating voltages on-chip. For example, in FBDIMM generating a 1 V operating voltage from 1.5 V supply voltage on-chip allows use of the more advanced 90 nm CMOS technology, leading to significant power savings for digital, switching circuits.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

Although the present invention has been described in terms of specific exemplary embodiments, it will be appreciated that various modifications and alterations might be made by those skilled in the art without departing from the spirit and scope of the invention.

What is claimed is:

1. A circuit comprising:

load logic for generating at least one control signal based on an operating mode of said circuit that indicates a target operating power state;

a digital linear voltage regulator, coupled to said load logic, comprising:

comparator, coupled to receive a reference voltage and an operating voltage supplied to a dynamic load for said circuit, for generating a binary output based on a comparison between said reference voltage and said operating voltage;

finite state machine coupled to receive said control signal, said finite state machine for receiving said binary output from said comparator and for generating a digital word based on said control signal and said binary output; and current digital-to-analog converter ("DAC"), coupled to said finite state machine, for receiving said digital word and for generating power to said dynamic load at said operating voltage to said circuit.

2. The circuit as set forth in claim 1, wherein said targeting operating power state comprises transitioning from a high power state operating mode to a low power state operating mode.

3. The circuit as set forth in claim 1, wherein said targeting operating mode comprises transitioning from a low power state operating mode to a high power state operating mode.

4. The circuit as set forth in claim 1, wherein said load logic for setting, via a control signal, a high current operating power state.

5. The circuit as set forth in claim 1, wherein said load logic further for setting, via said control signal, a low current operating power state.

6. The circuit as set forth in claim 1, wherein said finite state machine for setting an adjustment resolution that controls a rate of change of said control word and said current DAC over multiple clock cycles.

7. The circuit as set forth in claim 1, wherein:

said load logic for setting said control signal to indicate a transition from a low power state operating mode to a high power state operating mode or from a low power state operating mode to a high power state operating mode; and said finite state machine for setting a relatively high adjustment resolution to control a rate of change of said control word and said current DAC over multiple clock cycles in response to said control signal.

8. The circuit as set forth in claim 7, wherein:

said finite state machine further for subsequently decreasing said adjustment resolution to reduce a rate of change of said control word and said current DAC over multiple clock cycles.

9. A method for regulating power in a circuit, said method comprising:

generating at least one control signal based on an operating mode of a circuit to indicate a target operating power state for said circuit;

receiving a reference voltage and an operating voltage supplied to a dynamic load for said circuit;

generating a binary output based on a comparison between said reference voltage and said operating voltage;

receiving said binary output and generating a digital word based on said control signal and said binary output; and receiving said digital word and generating power to said dynamic load at said operating voltage to said circuit.

10. The method as set forth in claim 9, wherein said targeting operating power state comprises transitioning from a high power state operating mode to a low power state operating mode.

11. The method as set forth in claim 9, wherein said targeting operating power state comprises transitioning from a low power state operating mode to a high power state operating mode.

12. The method as set forth in claim 9, wherein said control signal indicates a high current operating condition.

13. The method as set forth in claim 9, wherein said control signal indicates a low current operating condition.

14. The method as set forth in claim 9, further comprising setting an adjustment resolution that controls a rate of change of said control word over multiple clock cycles.

15. The method as set forth in claim 9, further comprising:

setting said control signal to indicate a transition from a low power state operating mode to a high power state operating mode or from a low power state operating mode to a high power state operating mode; and setting a relatively high adjustment resolution to control a relatively high rate of change of said control word and said current DAC in response to said control signal.

16. The method as set forth in claim 15, further comprising:

subsequently decreasing said adjustment resolution to reduce a rate of change of said control word and said current DAC over multiple clock cycles.

17. A fully buffered dual in line memory module ("FB-DIMM") comprising:

load logic for generating at least one control signal based on an operating mode of said FBDIMM that indicates a target operating power state;

a digital linear voltage regulator, coupled to said load logic, comprising:

comparator, coupled to receive a reference voltage and an operating voltage supplied to a dynamic load for said FBDIMM, for generating a binary output based on a comparison between said reference voltage and said operating voltage;

finite state machine coupled to receive said control signal, said finite state machine for receiving said binary output from said comparator and for generating a digital word based on said control signal and said binary output; and current digital-to-analog converter ("DAC"), coupled to said finite state machine, for receiving said digital word and for generating power to said dynamic load at said operating voltage to said FBDIMM.

18. The FBDIMM as set forth in claim 17, wherein said digital linear voltage regulator further for generating a 1 V operating voltage from a 1.5 V supply voltage.

19. The FBDIMM as set forth in claim 18, wherein said FBDIMM is fabricated from CMOS process technology that is at least as small as 90 nm technology.

* * * * *